US010278887B2

(12) United States Patent
Khademhosseini

(10) Patent No.: US 10,278,887 B2
(45) Date of Patent: May 7, 2019

(54) CRUTCH AND SITTING DEVICE

(71) Applicant: Nami Khademhosseini, Falls Church, VA (US)

(72) Inventor: Nami Khademhosseini, Falls Church, VA (US)

(73) Assignee: ND PRODUCTS, INC., Falls Church, VA (US)

( * ) Notice: Subject to any disclaimer, the term of this patent is extended or adjusted under 35 U.S.C. 154(b) by 1 day.

(21) Appl. No.: 15/849,631

(22) Filed: Dec. 20, 2017

(65) Prior Publication Data

US 2018/0133093 A1 May 17, 2018

Related U.S. Application Data

(63) Continuation-in-part of application No. 14/641,313, filed on Mar. 7, 2015, now abandoned.

(51) Int. Cl.
*A61H 3/02* (2006.01)
*A61G 5/14* (2006.01)

(52) U.S. Cl.
CPC ..... *A61H 3/02* (2013.01); *A61G 5/14* (2013.01); *A61H 2003/0211* (2013.01); *A61H 2003/0283* (2013.01); *A61H 2201/0161* (2013.01); *A61H 2201/1635* (2013.01)

(58) Field of Classification Search
CPC ..... A61H 3/02; A61H 2003/001; A61H 2003/0211; A61H 2003/0233; A61H 2003/0283; A61H 3/0288; A61G 5/14
USPC ..... 135/69, 75, 66
See application file for complete search history.

(56) References Cited

U.S. PATENT DOCUMENTS

| | | | | | |
|---|---|---|---|---|---|
| 1,277,009 | A | | 8/1918 | Weldon | A61H 3/02 135/65 |
| 2,129,260 | A | * | 9/1938 | Bowser | A61G 5/14 188/2 F |
| 3,063,752 | A | * | 11/1962 | Moore | A61G 5/14 297/411.1 |
| 3,272,210 | A | * | 9/1966 | Boruvka | A61H 3/00 135/69 |
| 3,280,831 | A | | 10/1966 | McCall | A61H 3/02 135/68 |
| 3,301,268 | A | | 1/1967 | Tryon | A61H 3/02 135/69 |

(Continued)

*Primary Examiner* — David R Dunn
*Assistant Examiner* — Danielle Jackson
(74) *Attorney, Agent, or Firm* — MaxvalueIP, LLC

(57) ABSTRACT

In one example, we describe a device for Crutches and Sitting Device as an improvement of the basic crutch to provide needed support to ameliorate potential injuries and improve ambulation for persons suffering from injured lower limbs, lumbar region or other injuries, and who frequently require using crutches for mobility. Normally, the conventional crutches require more energy from the user than merely walking, and frequently, a crutch user may require rest. Prior crutch systems have not provided a convenient way to provide the user with such rest. We have solved all these problems here. Many other different variations are shown here, as well, such as walkers and specially curved handles for better grip and less/no injury. Also, we show crutch support in sitting position that works as a simple and handy decompression system for herniated or bulged discs and injured/weak back muscles.

10 Claims, 10 Drawing Sheets

(56) References Cited

U.S. PATENT DOCUMENTS 3,517,678 A * 6/1970 Gilsdorf ..... A61H 3/02 135/72
3,524,456 A 8/1970 Dixon ..... A61H 3/02 135/65
3,730,198 A 5/1973 Johnston ..... A61H 3/02 135/69
4,212,493 A * 7/1980 Ledesky ..... A61H 3/00 135/67
4,476,885 A 10/1984 Stein ..... A61H 3/02 135/69
4,565,409 A * 1/1986 Hollonbeck ..... A47C 16/00 297/411.1
4,838,291 A * 6/1989 Divito ..... A61H 3/02 135/68
4,993,446 A * 2/1991 Yarbrough ..... A61H 3/00 135/67
5,025,820 A * 6/1991 Gamper ..... A61H 3/02 135/69
5,339,850 A * 8/1994 Mertz ..... A61H 3/02 135/72
5,465,745 A * 11/1995 Davis ..... A45B 9/04 135/82
5,482,070 A * 1/1996 Kelly ..... A61H 3/02 135/66
5,865,180 A * 2/1999 Sigfrid ..... A61H 3/02 128/845
6,085,766 A 7/2000 Geary ..... A01B 1/00 135/68
6,675,820 B2 * 1/2004 Balan ..... A61H 3/008 135/67
7,360,547 B2 * 4/2008 Carlson ..... A45B 9/04 135/66
7,434,592 B2 10/2008 Larson ..... A61H 3/02 135/72
7,487,788 B2 * 2/2009 Baker ..... A61H 3/02 135/69
7,537,017 B2 * 5/2009 Baker ..... A61H 3/02 135/68
7,677,259 B1 * 3/2010 Arbuckle ..... A61H 3/04 135/66
8,418,704 B1 * 4/2013 Teeters ..... A61H 3/02 135/69
8,474,470 B2 * 7/2013 Albertyn ..... A61H 3/02 135/69
8,776,321 B2 * 7/2014 Doherty ..... B62K 21/26 16/422
8,800,579 B2 * 8/2014 Severson ..... A61H 3/02 135/72
8,844,548 B2 * 9/2014 Soletski ..... A45B 9/04 135/77
8,950,415 B1 * 2/2015 Spletzer ..... A61H 3/02 135/74
9,320,671 B2 * 4/2016 Gelfand ..... A61H 3/02
9,358,176 B1 * 6/2016 Vaeth ..... A61H 3/02
9,592,175 B2 3/2017 Soulakis ..... A61H 3/02
2006/0097020 A1 * 5/2006 Johnson ..... A61H 3/02 224/407
2007/0074749 A1 * 4/2007 Jones ..... A61H 3/02 135/73
2008/0029139 A1 * 2/2008 Pijanowski ..... A61H 3/02 135/67
2008/0173340 A1 * 7/2008 Robbins ..... A61H 3/00 135/72
2010/0258152 A1 * 10/2010 Lin ..... A61H 3/00 135/67
2013/0146111 A1 * 6/2013 Gelfand ..... A61H 3/02 135/71
2013/0263901 A1 * 10/2013 Severson ..... A61H 3/02 135/72
2015/0272812 A1 10/2015 Haider ..... A61H 3/02 135/69
2017/0319423 A1 * 11/2017 Khadennhosseini .... A45B 9/02

* cited by examiner

CRUTCH AND SITTING DEVICE

RELATED APPLICATIONS

This application is CIP of another application Ser. No. 14/641,313, filed on Mar. 7, 2015. We claim priority on the above filing date. We incorporate by reference all the teachings of the above application in this application.

BACKGROUND OF THE INVENTION

Reduced or inhibited mobility presents a significant problem for many people. Whether it is an injury to the leg, hip, wrist, lumbar, or the result of increased age, mechanical devices are often used for assisting the user to enhance their mobility. Canes, crutches, walking sticks and various other devices have been in use for a considerable time. However, the functional design of these devices has remained substantially the same. Unfortunately, for the user, these devices are often cumbersome, uncomfortable, and difficult to use in slippery surface situations and do not support the user's back adequately in the standing or seated position.

Persons suffering from injured lower limbs are frequently required to use crutches for mobility. However, crutches require more energy from the user than merely walking, and frequently, a crutch user may require rest. Prior crutch systems have not provided a convenient way to provide the user with such rest, and correct positioning for wrists, which necessitate support to the back and lower lumbar region. This support is important to the crutch user in both the standing and seated position.

It would also be advantageous for a crutch, or similarly constructed walking aid, to provide greater comfort for the user. It would be further advantageous for the walking aid to utilize the user's energy to mechanically assist the user, while walking. Furthermore, it would be advantageous for a walking aid to provide enhanced grip on slippery and/or uneven surfaces. It also would be advantageous for walking aid to provide an ergonomic handle that provide a correct hand rest and wrist positioning.

While various modifications have been attempted, there is presently no crutch that incorporates the appropriate ergonomic structure in a light-weight, sure gripping, user friendly, shock absorbing, ergonomic handle, and collapsible format. Now, we introduce different embodiments of our inventions:

The current invention, Crutches and Sitting Devices, is designed to ameliorate many health problems caused and exacerbated by the classic crutch design and provide the light-weight, sure gripping, user friendly, shock absorbing, ergonomic handle, and collapsible format that users need. This current invention is also designed to provide the support to the back a crutch user requires in both the standing and seated positions.

The injuries resulting from the traditional crutch use are in part due to the fact that patients overly rely upon the underarm portion to support the body weight. The invention here is designed to take considerable pressure from the underarm portion and support the body weight of the user ergonomically. This crutch is designed for the contour of the shape of the axilla. This minimizes potential underarm nerve injuries, like neuropraxia, and even complete paralysis of the arm. The design also ensures that the pressing weight of the body is not solely directly on the axilla, thus, minimizing the occurrence of muscle strain of the arms and shoulders, as well as joint pain to the shoulders.

Additionally, this improved crutch design minimizes and reduces injuries to the hand and wrist. The hand grip is contoured to fit a patient's palm, designed to maintain the hand and wrist in a neutral position, when the crutches are in use or at a e.g. 5 to 25 degree angle during ambulation. The general construction and design of existing crutch hand grips does not provide the correct ergonomic orientation between the wrist and forearm, even though padding may be present. Failure to achieve correct alignment and padding in the palmar area can result in disorders of wear and tear, including overuse syndromes, repetitive strain injuries, musculoskeletal injuries, and compressive neuropathies. Common injuries resulting in such usage include: carpal tunnel syndrome, wrist tendonitis, medial or lateral elbow epicondylitis, and rotator cuff muscle strains and tears. These disorders appear to be more common in the chronic crutch user, and are the result of repeated stresses on a particular musculoskeletal area. Thus, none of the traditional crutch constructions effectively support the users' body weight or torso in a comfortable manner so that they are able to walk using minimal energy with maximal comfort.

The following prior art references describe adjustable crutches, ergonomic cushions and had grips and curved crutch tips. These prior art, attempt to, but do not comprehensively solve the issues described above, and nor do these crutches provide ergonomic back support and spine decompression to a user who is seated. Further, these adjustable feature of the prior art are generally to support storage the crutch after use. However, the adjustability of ours facilitates a shorter support embodiment to support the user, while seated.

No other prior art has solved these problems this way and this efficiently.

Embodiments of the present invention generally relate to an orthopedic device to improve mobility and orthopedic support, while seated. More specifically, various embodiments of the present invention relate to multi-stage collapsible crutches that supports while both standing and seated.

Some of the prior art for the adjustable crutches are (which are listed in IDS, as well):

U.S. Pat. No. 8,844,548 teaches a walking aid support which includes an embodiment that comprises an oval shaped bottom and a downwardly angled slit. This support is configured facilitating walking and providing support in rough terrain.

U.S. Pat. No. 8,800,579 teaches an adjustable crutch designed to address three documented hazards or situations that may cause the crutch user to fall and injure themselves, however, it does not teach the support and amelioration of injuries to the underarm and hand, nor does it support the seated user.

U.S. Pat. No. 8,474,470 teaches an adjustable crutch designed to support an infirmed person's weight, while standing, but does not support the person's weight, while seated.

U.S. Pat. No. 8,418,704 teaches a power adjustable crutch assembly for assisting a user in transitioning between a seated position and a standing position. The assembly includes a support configured for positioning under an arm of a user. An upper frame is coupled to and extends downwardly from the support. A lower frame is in slide form coupled to the upper frame. An adjustment assembly is operationally coupled to the lower frame and the upper frame. It does not claim support for the user while seated, and as with most adjustable crutches, the adjustable characteristic is for ease of storage and/or usage in the standing position, not to support while seated.

U.S. Pat. No. 5,465,745, an adjustable crutch, includes upper and lower assemblies which are in slide format interconnected with one another and constructed of hollow aluminum pipes, or tubing, interconnected by glass or fiber-reinforced nylon members. The present invention has significantly more features to ensure the safety of the user and the three sliding members per staff allows the crutch to support the user in the seated position.

U.S. Pat. No. 7,360,547 is for a walking assist device which includes an elongate shaft having an adjustable length, a handle detachably connected to a proximal end of the elongate shaft, and a curved elongate base that mate to and engages a distal end of the elongate shaft.

U.S. Pat. No. 7,537,017 teaches a shoulder support assembly for an adjustable crutch. The shoulder support assembly is goaled to solve many of the health issues connected to the usage of the standard crutch, but does provide adequate support, and it lacks the obvious advantages of a standard adjustable crutch.

Deficiencies of the embodiments in these prior art references documented above are their lack of ability to balance mobility, walking steadiness, support the back while seated, and prevent tripping.

US Patent Application 2013/0263901 teaches a handgrip for a crutch that, unlike the claimed design, is offset from the plane of the crutch in both forward and rear end of the grip.

U.S. Pat. No. 8,776,321 teaches an ergonomic hand grip that provides shock absorption and reduces fatigue. More specifically, the present technology is a hand grip of varying thickness to permit support, while also absorbing shock and vibration.

U.S. Pat. No. 8,950,415 teaches a crutch system pertaining to assembly and disassembly purposes, and the assembly and the disassembly of the crutch system adapted to be done in a simple, safe, rapid and economical manner. As with crutches analysis, the detachable claim is related to ease of assembly, and not support the user while seated.

So, no other prior art has solved these problems this way and this efficiently, as described in our inventions below.

SUMMARY OF THE INVENTION

In one embodiment, we describe a method and a device as an improvement for the traditional crutch and its usage. More embodiments are given below: The current invention has the design and function that far exceeds those of a traditional crutch/walking/sitting aid. It deals particularly with a more comfortable construction in crutch design. This invention is designed to provide help and relief for more effective ambulation and improved posture, for disabled as well as pre- and post-operative population, e.g., patients with chronic herniated or bulging discs.

The present invention provides for a crutch base that addresses three hazards of the typical crutch:

1) losing balance on a slippery surface caused by the tip sliding out from underneath the person;

2) hitting an object or an obstacle on the ground with the walker causing the person to continue in motion through inertia, while the walker is stopped by the obstacle; and 3) being restricted by the walker as the person moves forward or slips backward as he/she grabs onto the walker for support, but the walker is insufficiently flexible to move with the person.

A first embodiment of the present invention is configured for persons with a relatively severe handicap and limited moving dexterity, generally unable to walk without a walking aid. This embodiment is configured for providing stability in bumpy or slippery walking terrains under a number of adverse situations that may occur. A second embodiment of the present invention is configured for use by persons who are not severely handicapped and use a walking aid, possibly for optional support, if, for example, one leg is sore or injured. Such a person would desire flexibility and only minimum movement restriction from the use of the walking aid.

The invention is also adjustable and allows the user to support his/her body weight in the seated position. This allows for more effective rest and reduces stress on the lumbar region. This is important and distinguishes this invention from the prior art. Using this design in the seated position elevates the upper body such that the user's upper body weight does add significant pressures to the lower back and spine. Thus, elevating and elongating the upper body reduces the pressure and stress to the lower body reducing the possibility of injury or worsening injuries, such as herniated discs and bulging discs, by decompressing the spine and alleviate upper body weight pressure on injured discs. The lower back is vulnerable to body weight pressures, while standing and seated, and this design minimizes those harmful pressures. This design also effectively supports the user's body weight/torso in a comfortable standing position so that the user is able to walk using minimal energy with maximal comfort.

In addition to supporting the user in ambulation and in the seated position, the design of the underarm cushion reduces stress and injury. This crutch cushion is designed to contour to shape of the axilla. The combination of the cushion form and special soft memory foam used in it minimizes potential underarm nerve injuries like neuropraxia, and even complete paralysis of the arm. The design also ensures that the pressing weight of the body is not directly on the axilla, thus minimizing the occurrence of muscle strain of the arms and shoulders, as well as joint pain to the shoulders.

Furthermore, the hand grip is contoured to fit a patient's palm and designed to maintain the hand and wrist in a neutral position when the crutches are in use or at a e.g. 5 to 25 degree angle during ambulation. The general construction and design of existing crutch hand grips does not provide the correct ergonomic orientation between the wrist and forearm, even though padding may be present. Failure to achieve correct alignment and padding in the palmar area can result in disorders of wear and tear, including overuse syndromes, repetitive strain injuries, musculoskeletal injuries, and compressive neuropathies. Common injuries resulting from such usage include: carpal tunnel syndrome, wrist tendonitis, medial or lateral elbow epicondylitis, and rotator cuff muscle strains and tears. These disorders appear to be more common in the chronic crutch user, and are the result of repeated stresses on a particular musculoskeletal area. Thus, this improved crutch design reduces injuries in ambulation, injuries to the hand through improved handgrips, and injures of the axilla, due to breathable gel and foam cushioning, and provides the user support and rest, while using the crutch, while seated.

DETAILED DESCRIPTION OF THE PREFERRED EMBODIMENTS

The following detailed description is for various embodiments, as some were explained above, as well. The description is not to be taken in a limiting sense, but is made merely for the purpose of illustrating the general principles of the invention, or as some examples.

Figures 1, 2, 3, 4:
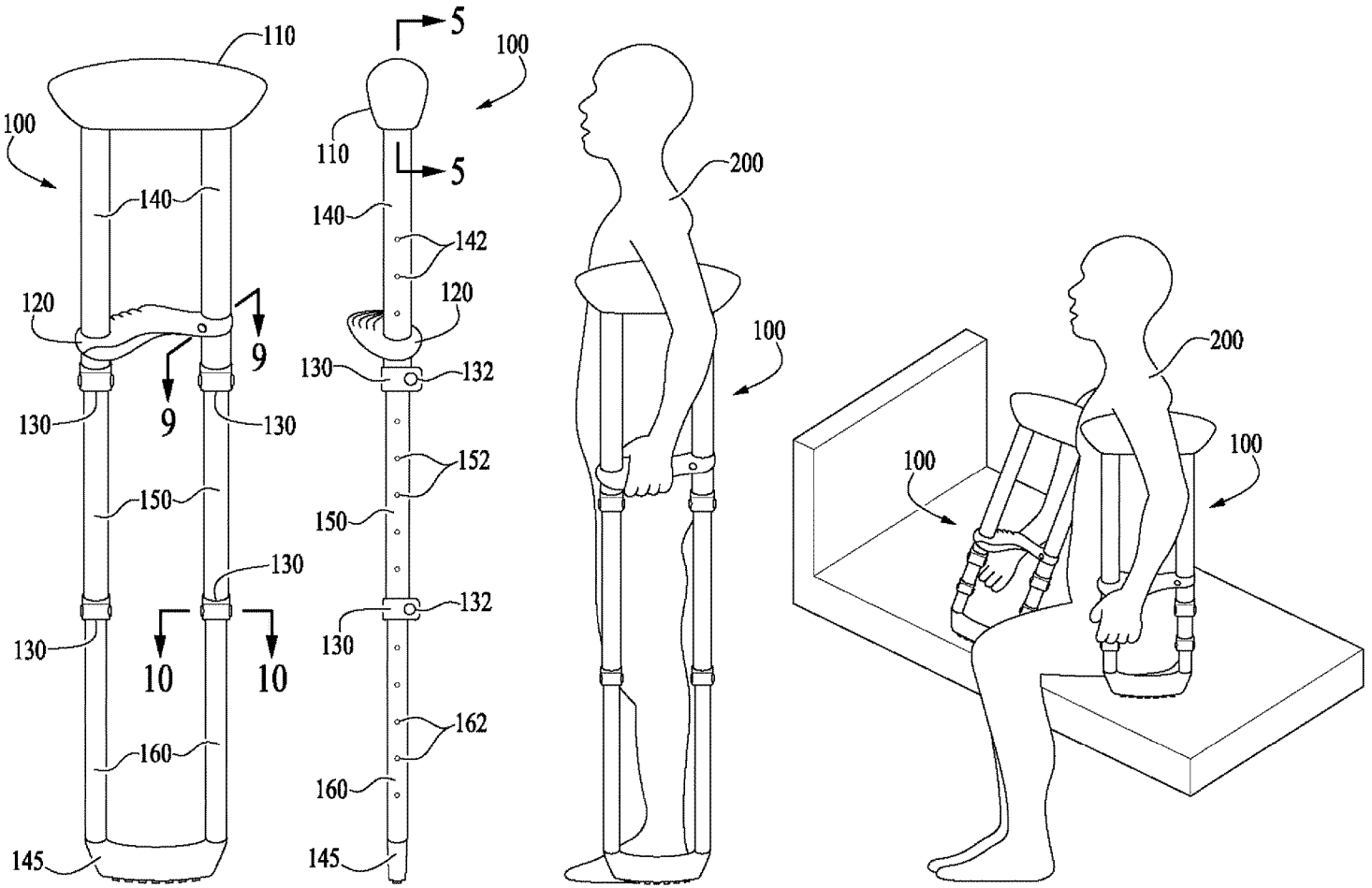
FIG. 1 shows a side view of the adjustable crutch.
FIG. 2 shows a frontal elevation view of the adjustable crutch.
FIG. 3 shows a side elevation view of the adjustable crutch. The side view shows a human holding the hand grip and being supported in standing position.
FIG. 4 shows a roughly 45 Degree angled elevation side view of the adjustable crutch, used by a human in the seated position. The view shows the use of the crutch adjusted to be used to support a seated human.

The Design for Crutches and Sitting Devices is an embodiment of a crutch comprising a pair of support shaft members. Each member is comprised of three shafts, 140, 150 and 160. FIGS. 1 and 3 show supporting member 140, the top member of the support shaft, while supporting members 150 and 160 are also shown in FIGS. 1 and 2, which are the middle and bottom members, comprising the support staff. Each supporting element of the crutch, 140, 150, and 160, is designed to maintain the telescoping adjustable character and is of different internal and external diameters. Each support staff includes a plurality of adjustment holes shown in FIGS. 2, as 142, 152 and 162. These adjustment holes receive the wrap around snap, as in FIGS. 9 and 10, which secures the members in place and prohibits the members from sliding in a telescoping manner, which facilitates the adjustability of the crutches. The supporting elements may be fabricated of metal, such as steel aluminum, steel, and titanium, or another appropriate material, and are formed in a generally hollow cylindrical shape.

Figure 5:
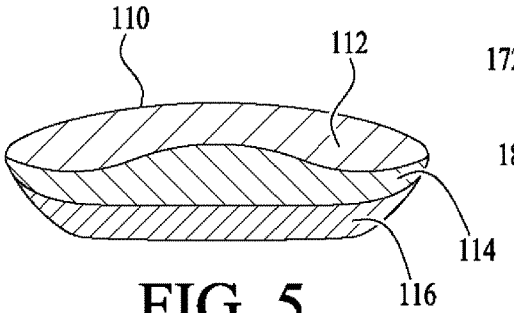
FIG. 5 shows a side cross section view of the cushion of the crutch.

The underarm support crutch cushion is shown on FIG. 5, plus element 110 on FIG. 1, located toward the proximal end of the support shaft member, shown as 140, in FIG. 1, and it is comprised of gel infused memory foam (open cell) cushion top layer of the underarm cushion, to absorb jarring motions of ambulation, creating a more even and more comfortable ambulation.

Another embodiment of this invention is directed to a method of making a composite material of the underarm support crutch cushion, comprising: providing a layer of foam material.

The cushioning article or element, as illustrated in FIGS. 1 and 5, may also comprise a barrier layer of thermoplastic polyurethane (TPU) as the middle layer 114 of the cushion (with 116, as the solid base/cradle for supporting 2 upper layers).

Figure 11:
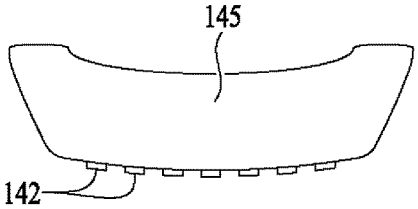
FIG. 11 shows a side view of the elastic bottom part.

In addition to the under arm support cushion, a trapezoidal shaped bottom element 145, FIG. 1, and shown in details in FIG. 11, may be used at the distal end of support shaft element 160. The trapezoidal bottom is designed to assist in ambulating over uneven surfaces and to provide a cushioning effect. The trapezoidal shaped tip, connected to both the front and rear end of the crutch, provides appropriate friction between the crutch 100 and the walking environment. The trapezoidal curved shape of the base of the crutches provides a smoother, more even mode of ambulation, which is more natural and more comfortable for the user.

a. A walking aid support comprising a substantially trapezoidal bottom for engaging a walking ground; and
b. A pattern of "treads" or grooved patterns at the bottom of the trapezoidal base. The elastic base is made of a combination of softer (53 A Shore) and harder plastic (75 A Shore), which can provide a more solid grip on different surfaces, such as slippery ice, water, or uneven surfaces; and
c. The acute angle of the base is between about 0 degrees (at the midpoint of the base) and about 45 degrees (as it reaches each of the structural tubes).

Figure 7:
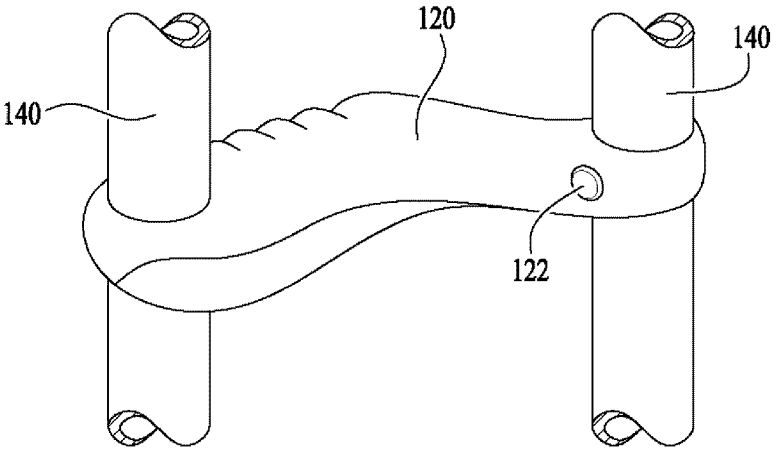
FIG. 7 shows a side view of the handgrip as it is connected to the crutch.
Figure 8:
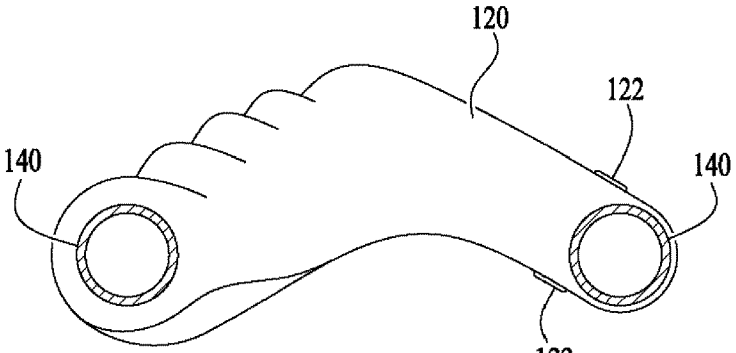
FIG. 8 shows a top view of the handgrip.

The hand grip 120 has the appropriate contours and ergonomic angulation to fit the palm and align the wrist. The hand grip 120 is shown in details in FIGS. 7 and 8. FIG. 8 shows that hand grip 120 has an angled offset from the rear in the range of 0.5" to 3.0". There is no offset distance from the forward tube, and the handgrip has a triangular shape. The angle of the handgrip device, shown in FIG. 7, due to the difference between the back and front end vertical positioning, is between 5 and 25 degrees down from rear to front, as just examples, but not limiting the teachings here, as is the case for other numbers in the disclosure, as examples only.

The handgrip device, FIG. 8, is made or encased in a molded ergonomic grip shape for improved weight distribution.

a. The present crutch provides a hand grip that is comprised of two different plastics, e.g., one at 53 A and one at 75 A Shore; and
b. By mixing the pliability of the two different plastics, the grip has the ability to feel "dry" even when wet by perspiration or by weather; and
c. The grip of the crutch has grooves that are perpendicular to the lines of muscular tension, thus allowing for a steadier and stronger grip or grasp, shown clearly in both FIGS. 7 and 8.

As indicated above, the crutch is adjustable and can be secured in various positions that ensure comfort and amelioration of injuries associated with normal use. Once adjusted to the appropriate height for the user, via telescoping effect of the 3 support members, 140, 150, and 160, wrap around snap, 130, will be used to secure the support members in place. Alternative devices may be used as latching mechanisms, instead of the illustrated wrap around snaps. (For example, a single pin with a radial biased outward.)

FIG. 1 shows a side view of the adjustable crutch. FIG. 2 shows a frontal elevation view of the adjustable crutch. FIG. 3 shows a side elevation view of the adjustable crutch. The side view shows a human holding the hand grip and being supported in standing position. FIG. 4 shows a roughly 45 Degree angled elevation side view of the adjustable crutch, used by a human in the seated position. The view shows the use of the crutch adjusted to be used to support a seated human.

Figure 6:
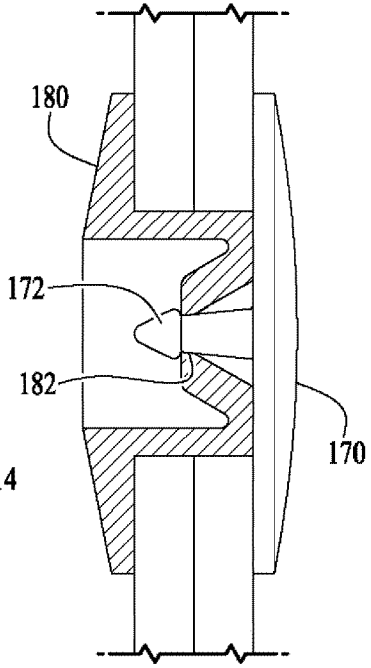
FIG. 6 shows a side cross section view of the rivets that are used to secure the crutch's replaceable cover on the cushion. It can be used as an alternative to snap button for attachment/detachment the cushion cover to the under arm cushion.

FIG. 5 shows a side cross section view of the cushion of the crutch. FIG. 6 shows a side cross section view of the rivets that are used to secure the crutch's replaceable cover on the cushion. FIG. 7 shows a side view of the handgrip as it is connected to the crutch. FIG. 8 shows a top view of the handgrip.

Figure 9:
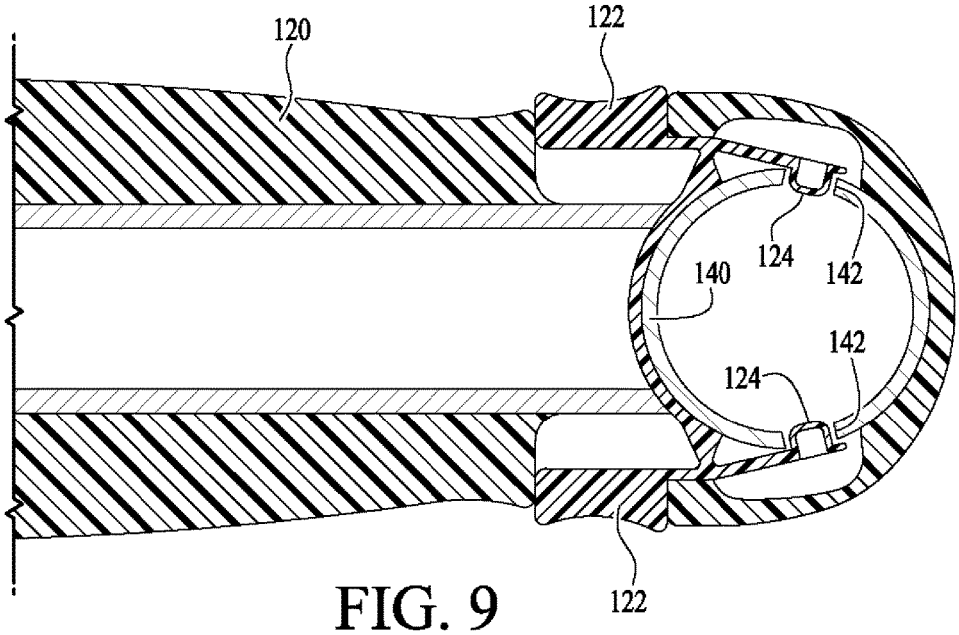
FIG. 9 shows a top cross sectional view of the wrap around snap system locking the handgrip from outside of the upright support, inlayed in the handgrip.
Figure 10:
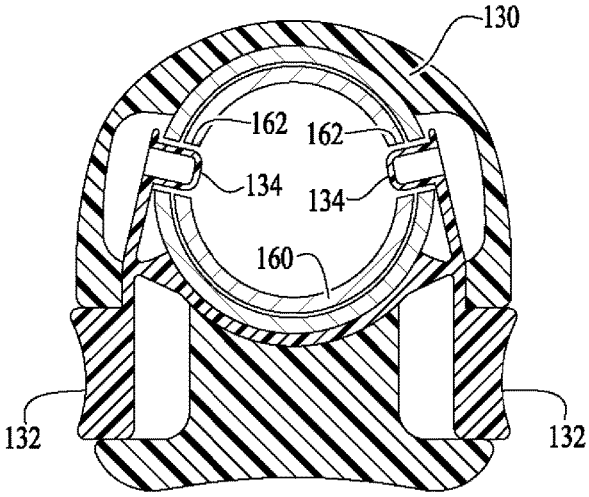
FIG. 10 shows a top cross sectional view of the wrap around snap located in the conjunction of each two segments of the crutch shaft.

FIG. 9 shows a top cross sectional view of the wrap around snap inlayed in the handgrip. FIG. 10 shows a top cross sectional view of the wrap around snap located in the conjunction of each two segments of the crutch shaft. FIG. 11 shows a side view of the elastic bottom part.

In one example, we describe a device for Crutches and Sitting Device as an improvement of the basic crutch to provide needed support to ameliorate potential injuries and improve ambulation for persons suffering from injured lower limbs, lumbar region or other injuries, and who frequently require using crutches for mobility. Normally, the conventional crutches require more energy from the user than merely walking, and frequently, a crutch user may require rest. Prior crutch systems have not provided a convenient way to provide the user with such rest. The current invention fulfills at least two functions, as an example of the device or system: (i) providing improved walking aid for those recovering from orthopedic surgery of the spine and lower extremities, as well as those who suffer from permanent disability from the spine and lower limbs; and (ii) improved sitting aid for those recovering from orthopedic surgery of the spine and lower extremities, as well as those who suffer from permanent disability of the spine and lower limbs, such as people with chronic herniated or bulged disc in their spine, as examples. Many other different variations are shown here, as well.

Other embodiments: The present invention has for its primary object to provide a more comfortable and supportive mode of ambulation using an upgraded version of the traditional crutch, which can easily be converted into a sitting aid. When compared to current crutch designs, the present invention offers a number of improvements, as mentioned above.

Other embodiments: An adjustable crutch to aid mobility of a user in moving over various walking surfaces and support the user in the seated position. The adjustable crutch comprises: (a) two telescoping shaft elements each comprised of three tubes, an upper, middle, and bottom tube, each of which is configured to slide in the adjacent lower tube to adjust the height of the crutch; (b) a hand grip element at the distal end of the upper tube. The hand grip is configured for the user to grasp to support the weight of the user; (c) a cushion configured to fit beneath an underarm of the person. The cushion being attached to proximate ends of the upper tubes; and (d) a crutch bottom or tip assembly, configured to engage the walking surface, when the person uses the crutches to move over the walking surface, and the crutch bottom being attached to ends of the lower tubes.

The adjustable crutch, wherein each of the pair of lower tubes is configured to slide inside one of the pair of middle tubes and the each pair of middle tubes is configured to slide inside one of the pair of top tubes, thus, ensuring adjustability of the height of the crutch via the telescoping characteristic of the tubes and ensuring that the crutch can facilitate a height consistent with use of the crutch to support the user while seated.

The adjustable crutch, with a more pliable design of the armpit cushion, which will absorb shock incidence, creating a more comfortable and natural mode of ambulation. A more secure and stable support for the users' posture and torso, which is attached directly to the tubular longitudinal structure, creating a more comfortable and less painful mode of ambulation or sitting position.

The adjustable crutch, wherein the upper portion of the under-arm cushion, FIG. 5, consists of a layer of gel-infused open cell memory foam material in direct contact with the cushion cover, extending from the upper surface of the cushion to the middle layer, in which it comprises of a soft and flexible plastic core piece, and the bottom layer. (The solid base, which supports the middle and top layer and is adjacent to the top end of the shafts.)

The cover is removable so that users can clean or replace the cover, as it is vulnerable to under-arm perspiration and other forms of dirt, and the upper portion of the under-arm cushion, which can be removed and cleaned with common anti-bacterial soap/detergent and replaced on top of the middle portion (plus the removable upper portion of the under-arm cushion, attached to the lower portion with embedded protruding metal snaps, or rivets (plus the removable upper portion of the under-arm cushion, which is also disposable (and new cushions can be ordered to replace these items, should the user want to do so))).

The adjustable crutch, with a more secure and stable support for the user's posture which is attached directly to the tubular longitudinal structure, creating a more comfortable and less painful mode of ambulation or sitting. The support comprises a dual, parallel design of the supporting poles, providing more consistent and reliable ambulatory motion; a locking, wrap-around snap which includes pins that can be inserted into the openings, as shown in FIGS. 9 and 10, and snap into place for the positioning of the overall height of the crutch (for walking or as adjusted for sitting); and the length of distance from the under-arm cushion to the handgrip of the crutch; and the distance of the handgrip to the ground, which can be adjusted as a walking aid or as a sitting aid.

The adjustable crutch, wherein the crutch has two support poles extending from the top of the crutch downward toward the ground, comprising: a handgrip element, for handgrip device for an ambulation assistance; one handgrip element support pole attachment mechanism for each pole bridged by the handgrip element, wherein the attachment mechanisms are user installable and removable, and provide a support for the handgrip element spaced outboard from the plane of the poles away from the body side of the crutch by an offset distance. There is no offset distance from the forward tube (thumb end) end of the handgrip, while there is the offset distance from the rear tube, when installed on the crutch.

a. The handgrip device, wherein the offset distance from the rear tube is in the range of 0.5" to 3", or from 5 degrees to 25 degrees, as only examples, to maintain a stress-neutral position; and the vertical positioning of the forward end of the handgrip is lower to the ground from then the back end vertical positioning of the handgrip; and the handgrip is curved outward relative to the plane of the support poles.

The adjustable crutch, wherein the handgrip device offset distance from the rear tube is 0.5" to 3" (inches), or from 5 to 25 degrees, to maintain a stress-neutral position; the handgrip, wherein the angle of the handgrip element due to the difference between the back and front end vertical positioning is between 5 and 25 degrees down from rear to front. The handgrip device is at least one made or encased in a molded ergonomic grip shape for improved weight distribution. The hand grip is comprised of two different plastics, one at 53 A and one at 75 A Shore, which by mixing the pliability of the two different plastics, the grip has the ability to feel "dry" even when wet by perspiration or by weather. And the grip of the crutch has grooves that are perpendicular to the lines of muscular tension, thus allowing for a steadier and stronger grip or grasp. The grip also can have a core solid support across the upright supports (Appendix 3-2 metal core piece), which bears the weight of the user hand. The solid core piece is over-molded by elastic soft material to provide comfortable and safe grip.

The adjustable crutch, with a trapezoidal or curved shape of the base of the crutches, to provide a smoother, more even mode of ambulation, which is more natural and more comfortable for the user; a pattern of "treads" or grooved patterns in the bottom of the trapezoidal or curved base, made of a combination of softer (53 A Shore) and harder plastic (75 A Shore), which can provide a more solid grip on different surfaces, such as slippery ice, water, or uneven surfaces; and the acute angle of the base is between about 0 degrees (at the midpoint of the base) and about 45 degrees (as it reaches each of the structural tubes).

The following Items are shown in various figures, i.e., FIGS. 1-11:

Item 112 (right side curvature on top of underarm support crutch cushion, or item 110 in e.g. FIG. 5), (left side curvature on top of underarm support crutch cushion), 116 (bottom side of underarm support crutch cushion), 170 (the disc behind the pin, as the end of the pin), 172 (pin head for connection, to hold the parts together, as shown in FIG. 6), 182 (the hole that pin head goes through, to hold the parts together, as shown in FIG. 6), 180 (the assembly where the pin is attached to, to hold the parts together, as shown in FIG. 6), 122 (spring loaded pin, coming out of the tube, from the other side, to adjust the height and hold the sections as one piece, as shown in FIG. 7), 124 (the extension pins, coming out toward the center of circle cross section, for the opening hollow section along the vertical rod 140 in FIG. 2, to attach rod 140 to the body of the handgrip, as shown in FIG. 9), 140 (vertical rod/upright pipe/support, as a section of the vertical parts of the crutch, located along the length or height of the crutch, as shown in FIG. 1 or FIG. 2), 142 (the opening on the circumference of the circle cross section, which engages with item 124, to get fitted with item 124, and to hold the vertical rod 140 (as part of the crutch shaft) stationary with respect to the body of the handgrip or item 120 (as the middle section of the handgrip), as shown in FIG. 9), 130 (wrap around snap's body, shown in FIG. 10 or FIG. 1), 145 (bottom section of the crutch, shown in FIGS. 1, 2, and 11), 132 (buttons on the side of wrap around snap, item 130, in FIG. 10), 134 (the extension pins, coming out toward the center of circle cross section, for the opening hollow section along the vertical rod, e.g., item 160 in FIG. 1, to attach rod 160 to another rod, as a part of the crutch shaft, e.g., item 150 in FIG. 1, with the horizontal cross section as shown in FIG. 10), 160 (a vertical rod, as a part or section of the crutch shaft), 162 (the opening on the circumference of the circle cross section, which engages with item 134, to get fitted with item 134, and to hold the vertical rod 160 (as part of the crutch shaft) stationary with respect to another vertical rod (as part of the crutch shaft), e.g., item 150 (as part of the crutch shaft), as shown in FIG. 10 or FIG. 1), 142 (the small dots at the bottom of item 145, i.e., the bottom section of the crutch, shown in FIGS. 1, 2, and 11, for better grip and less slipping/accidents), and 200 (a typical human/user, with hand, shoulder, and arm grabbing the crutch at different locations as shown in FIGS. 3-4).

For vertical parts of the crutch, or crutch shaft, we have multiple sections or parts or rods, which are connected together, as shown in FIGS. 1-4. The parts or rods are called with different names across this disclosure, e.g., as "shaft", "supporting member", "supporting element", "supporting staff", "supporting shaft member", or "support shaft element". However, all refer to the same thing, i.e., as pieces or sections or parts or elements or members of the crutch shaft, in vertical direction, as a shaft or bar which supports the weight of a person or user along the crutch, in vertical direction, as shown in FIGS. 1-4. Thus, all phrases above are interchangeably used in the disclosure.

The adjustable crutch, which comprises a more secure, wrap-around locking snaps that allow adjustments from a walking crutch to an aid for sitting or getting out of a chair, with crutch comprising a bottom portion, a top portion, and a middle portion, and wherein wrap around snaps are used to secure the shaft element to one another and lock them in the height that they are adjusted to.

Wrap around snap comprises of two push buttons in which engage or disengage the pins which lock or unlock the telescoping shafts.

Appendix 1, pages 1-5, have many variations of our inventions shown in FIGS. 1-11, above. Appendix 2, pages 1-5, show the variations and details of the handle for this invention, as some embodiments.

One example of usage/advantage: According to some medical research and publications, e.g., from the Internet sources, the nonsurgical spinal decompression is a type of motorized traction system that may help relieve back pain. Spinal decompression works by gently stretching the spine. That changes the force and position of the spine. This change takes pressure off the spinal disks, which are gel-like cushions between the bones in your spine, by creating negative pressure in the disc. As a result, bulging or herniated disks may retract, taking pressure off nerves and other structures in the spine. This in turn, helps promote movement of water, oxygen, and nutrient-rich fluids into the disks so they can heal. So, our crutch can have a very positive effect on this healing process and recovery, as an example.

In addition, the correct alignment of the hand, wrist, and arm, with respect to the handle is very important, as the correct orientation prevents injury to the wrist and hand of the user. Our handle design and orientation with correct alignment for the hand, wrist, and arm are shown in various Figs. of Appendix 2, pages 1-5.

So, there are many advantages for our inventions, including, e.g.: 1) releasing/reducing pain by spinal decompression in sitting position, and 2) preventing side effect of wrist pain for crutch users.

One of the features of this invention is the unique handle it has, which helps the user or patient for recovery and avoiding any injury.

In one embodiment, we have a cushion top for the handle.

In one embodiment, we have a spring-action for the handle.

In one embodiment, we have a saddle shape, as shown in the figures/appendices.

In one embodiment, we have a rocking-action for the under-arm support.

Figure 16:
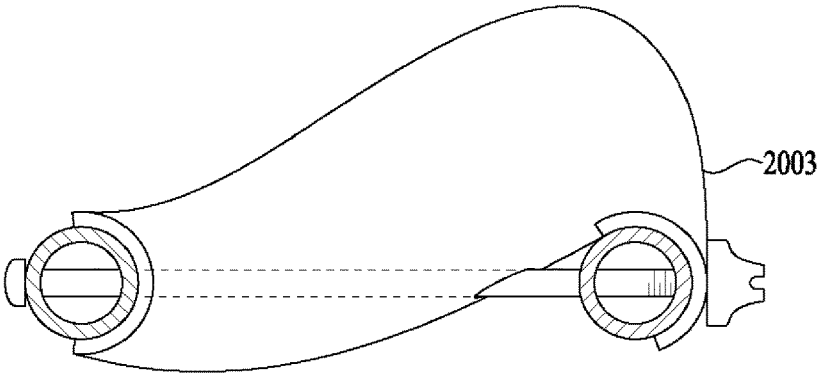
FIG. 16 shows the handle 2003 with attachments and components. It shows a different handle. This handle is designed to be closer to the rod axis with a slight angle to the axis.

In one embodiment, we have pointer finger and thumb are supported by the handle properly, which is a big advantage over the prior art. In one embodiment, as shown in FIG. 16, we have a novel handle for the best grip position, with the left side of the FIG. is pointing toward the front of the user (the front side of the handle). The front side of the handle is closer to the shaft (or the vertical bar/support for the crutch) than the opposite/back side of the handle, which is placed at a larger distance from the other shaft of the crutch (e.g., based on the average distance, or center-of-mass distance to the shaft, for each piece or portion), as shown in FIG. 16.

The cross section of the handle shown in FIG. 16 is also very different from that of the prior art, which is rectangular in shape, and comes out from front and back sides. Generally, the conventional crutch grip causes pain in the hand/wrist/muscles/skeleton. So, our inventions are very helpful to avoid the damage and pain for the user.

Figure 15:
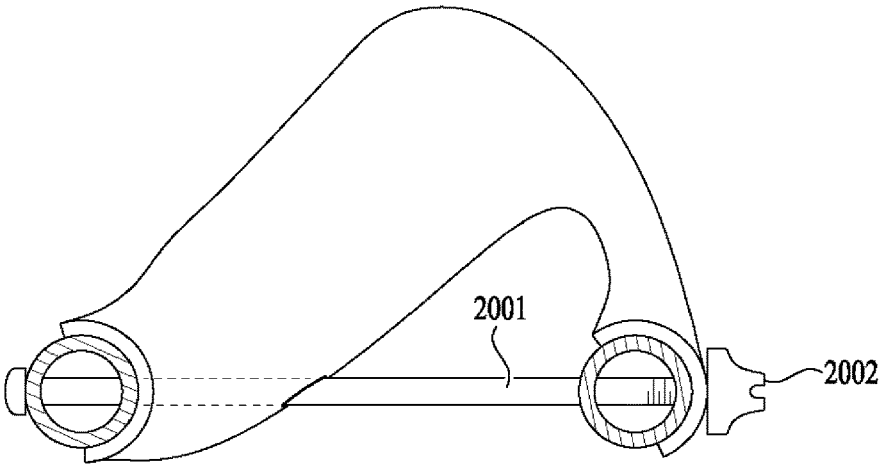
FIG. 15 shows rod 2001 and bolt 2002.

FIG. 15 is a variation of FIG. 16, but the curve of the handle has come out even further out, away from the center or shafts of the crutch. This is for people with different shape/size of hand, but generally, it is very helpful to avoid the damage and pain for the user, similar to the handle shown in FIG. 16, but with different shape, curve, boundary, angle, or extension.

Appendix 3, pages 1-4 and 12, show various parts of the crutch in different embodiments. The first 3 pages are the same crutch in 3 different positions: Each position shows how each segment is moved/slid into the upper telescopic segment, until the bottom and middle segments are completely slid into the top segment, which makes the crutch prepared for use in sitting position. Appendix 3, pages 5-6 and 9-11, show the embodiments for the handle. Appendix 3, page 7, shows the embodiments for the grooved tubes inside each other, e.g., telescopic, pulling out/sliding, for groove, e.g., for pin connection and attachment, to secure the position.

The explanation for Appendix 4, pages 1-5, Sit-Crutch, for a walker:

A walker with vertical holes on the hand bar, which provides our invention/embodiment (Sit-Crutch) bottom support, with insert holes, and affixed to the sit-crutch (collapsed/slide into the top segment or the detached crutch) on the walker.

It is intended to help patients with weakness on both upper body and lower body, and extremities disorders, to experience a safer and more supportive positions, while standing or walking with this walker/crutch integrated system.

Appendix 4, pages 1-2, 4-5, show various components for Sit-Crutch or crutch for various embodiments. Appendix 4, page 3, shows specifically for a walker, which can be combined/exchanged with the components of the crutch invention, mentioned here.

Page 8 in Appendix 3 shows a general suggestion by physicians for a correct/normal hand structure, based on relative position and rotation of fingers and hand/wrist/bone structure in hand/wrist, as shown there in X-ray type/style format, by others. That is why we improved/invented our new/novel crutch handle/grip, to reduce damages, pressure, and stress on hand/wrist/fingers, with proper posture for skeleton/muscles, with no abnormal extension/twist/pressure, with less or no problems for the user/patient.

FIG. 9 shows the solid core that is weight bearing part, which goes through the handle across the upright supports and attached by brackets. The grip will be over-molded on this solid core, as the soft part of the grip.

Figure 12:
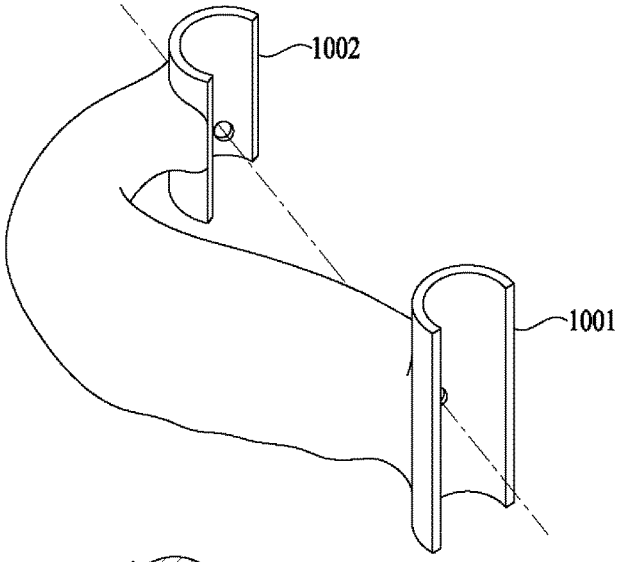
FIG. 12 shows a side view of the handle with larger front bracket (1001) and back bracket (1002), which secure the handle attachment to the upright supports/crutch shafts or bars.
Figure 13:
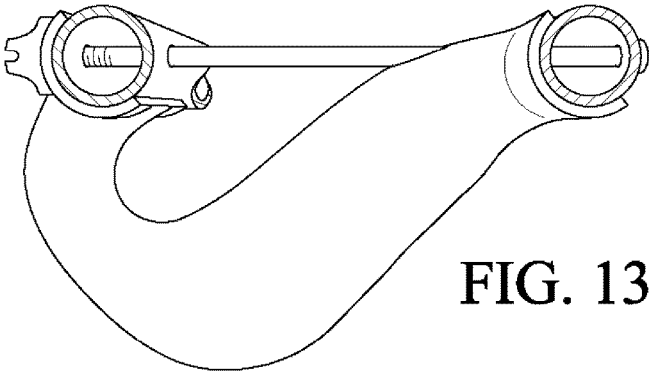
FIG. 13 shows the rod through the upright support holes, to fasten handle, by new bolt to the supports. This is a very different handle with respect to the prior art, in which the top view looks like a rectangle with parallel connections to the support poles.

FIG. 12 shows a side view of the handle with larger front bracket (1001) and back bracket (1002), which secure the handle attachment to the upright supports/crutch shafts or bars. FIG. 13 shows the rod through the upright support holes, to fasten handle, by new bolt to the supports. This is a very different handle with respect to the prior art, in which the top view looks like a rectangle with parallel connections to the support poles.

Figure 14:
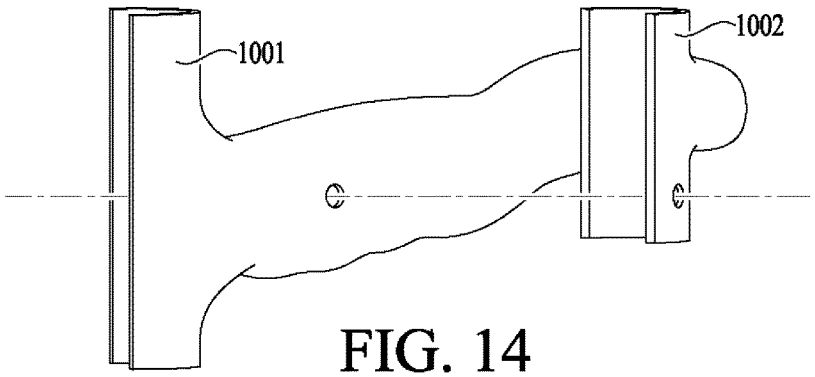
FIG. 14 shows how the rod passes through the handle and both brackets.
Figure 17:
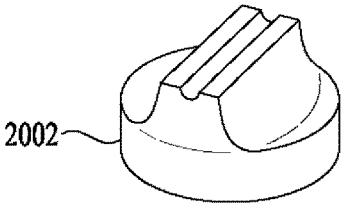
FIG. 17 shows a bolt 2002 that can be twisted at the end of the rod, either by fingers (thumb and point finger), using the curved sides, or by using screw driver, by inserting it into the slot (opening) in the middle.

FIG. 14 shows how the rod passes through the handle and both brackets. FIG. 15 shows rod 2001 and bolt 2002. FIG. 16 shows the handle 2003 with attachments and components. It shows a different handle. This handle is designed to be closer to the rod axis with a slight angle to the axis. FIG. 17 shows a bolt 2002 that can be twisted at the end of the rod, either by fingers (thumb and pointing finger), using the curved sides, or by using screw driver, by inserting it into the slot (opening) in the middle.

Figure 18:
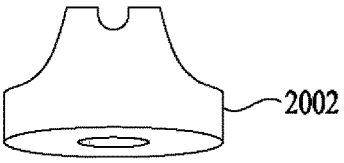
FIG. 18 shows a bolt 2002 that can be twisted at the end of the rod, either by fingers (thumb and point finger), using the curved sides, or by using screw driver, by inserting it into the slot (opening) in the middle.
Figure 19:
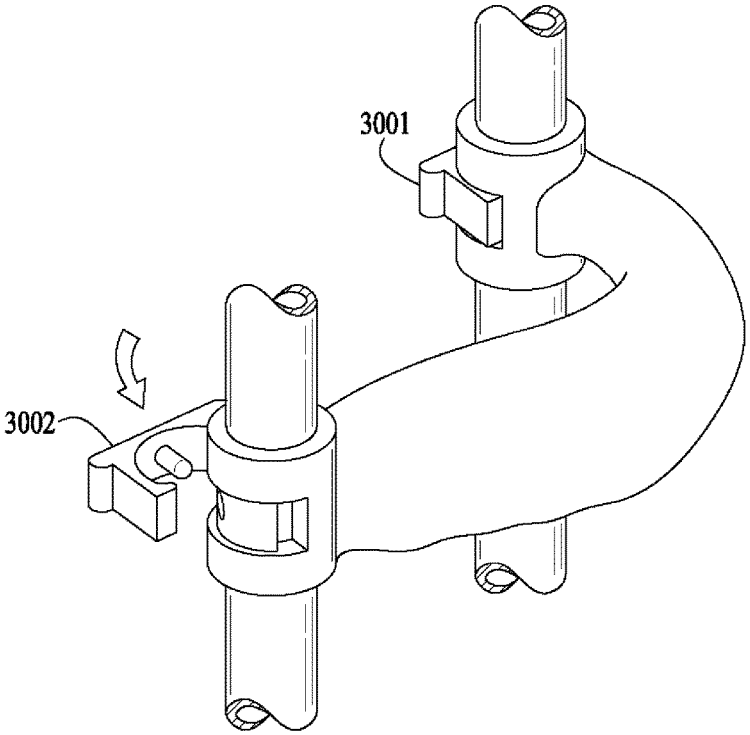
FIG. 19 shows the use of the locks to secure handle on the supports: open 3002 and closed 3001 positions.
Figure 20:
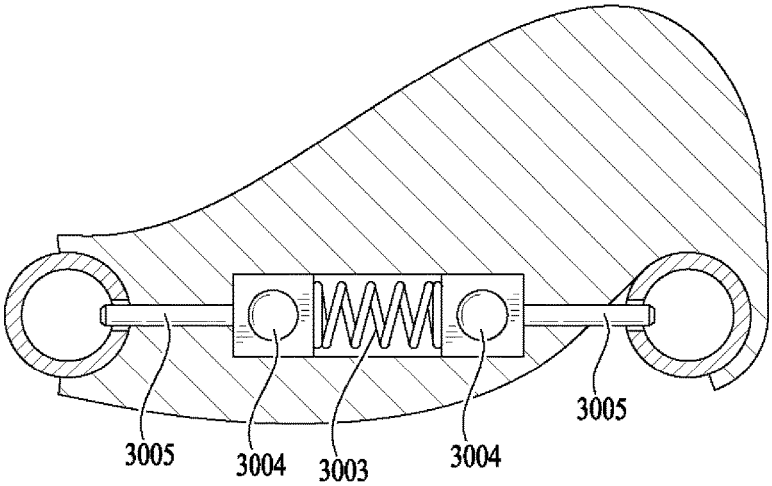
FIG. 20 shows a new feature/function that uses two concaved tabs (3004) for two-finger placement, that can be pushed together, and as they squeeze the spring (3003), they pull both locking pins (3005) to the center, therefore, releasing the handle system from the upright supports for position adjustment.

FIG. 18 shows a bolt 2002 that can be twisted at the end of the rod, either by fingers (thumb and point finger), using the curved sides, or by using screw driver, by inserting it into the slot (opening) in the middle. FIG. 19 shows the use of the locks to secure handle on the supports: open 3002 and closed 3001 positions. FIG. 20 shows a new feature/function that uses two concaved tabs (3004) for two-finger placement, that can be pushed together, and as they squeeze the spring (3003), they pull both locking pins (3005) to the center, therefore, releasing the handle system from the upright supports for position adjustment.

Figure 21:
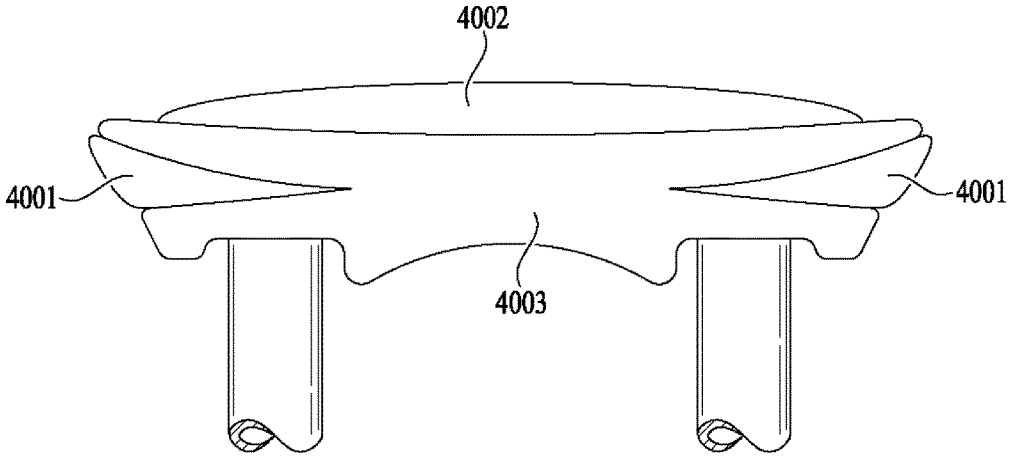
FIG. 21 shows a new cushion which comprises of a top layer of gel infused memory foam 4002 (for cooling under arm, while in use), plus air capsule/balloon/bubble or bouncy materials 4001, plus (highly) bouncy/elastic material(s) 4003.

FIG. 21 shows a new cushion which comprises of a top layer of gel infused memory foam 4002 (for cooling under arm, while in use), plus air capsule/balloon/bubble or bouncy materials 4001, plus (highly) bouncy/elastic material(s) 4003. A highly elastic material is e.g. elastic rubber or air/gel capsules, similar to the ones in the sport shoes, to help with more energetic ambulation, and less shock, while the crutch hits the ground, to reduce the impact on the underarm (as shock absorbent), together with 4001 and 4002, plus open cell foam, which is used as cushion (which is breathable) (with air passing through the open cells).

Figure 22:
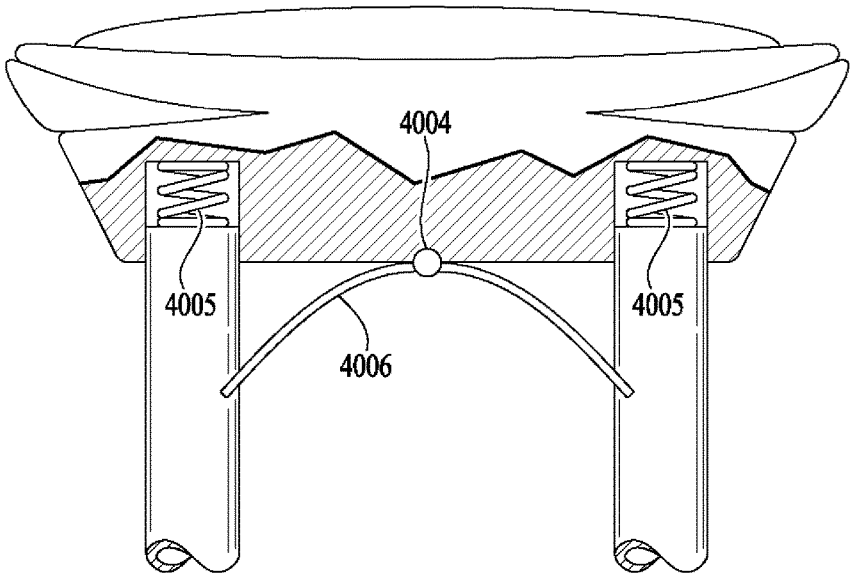
FIG. 22 shows swinging design for cushion. The crutch middle is swing at the pivot point 4004, where it is affixed to the curved support 4006, with springs 4005.

FIG. 22 shows swinging design for cushion. The crutch middle is swing at the pivot point 4004, where it is affixed to the curved support 4006, with springs 4005. Each side of the cushion is supported by the flexible spring 4005, which helps leveling the underarm cushion to horizontal position/straight/level, in parallel to the ground, while the user is walking. This may help eliminating the pressure and impact to the front and back of the underarm (and vulnerable nerves in the underarm), to provide smoother ambulation.

Figure 23:
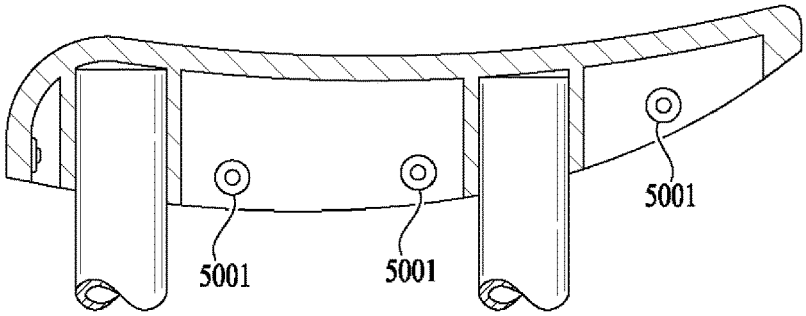
FIG. 23 shows a different form of the underarm cushion, which is moved more to the back of the crutch and is shorter in the front, plus the snap buttons that can be used, instead of rivet (5001).
Figure 24:
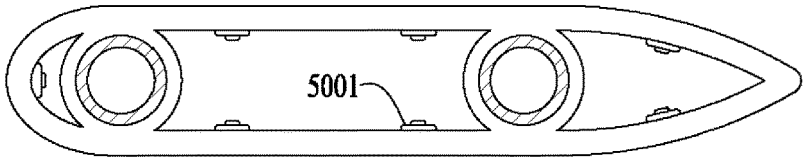
FIG. 24 shows under the underarm structure: the male part of the snap buttons are affixed under the structure.
Figure 25:
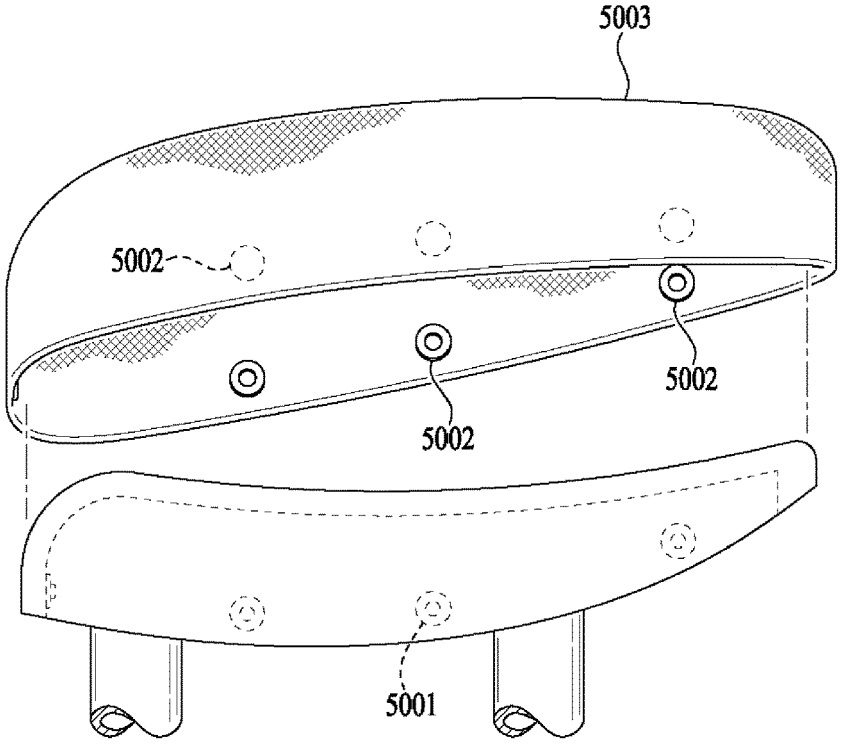
FIG. 25 shows a replaceable/washable cover (5001) plus the female part of the snap button, facing inside of the cover. Female part (5002) of the cover snap on the male part, affixed under the underarm cushion, to secure the washable cover over the cushion (5003).

FIG. 23 shows a different form of the underarm cushion, which is moved more to the back of the crutch and is shorter in the front, plus the snap buttons that can be used, instead of rivet. FIG. 24 shows under the underarm structure: the male part of the snap buttons are affixed under the structure. FIG. 25 shows a replaceable/washable cover (5001) plus the female part of the snap button, facing inside of the cover. Female part (5002) of the cover snap on the male part, affixed under the underarm cushion, to secure the washable cover over the cushion (5003).

In one embodiment, we have: A crutch system, said crutch system comprising: multiple vertical bars; wherein said multiple vertical bars are connected together; wherein said multiple vertical bars are adjustable in length and in number, to adjust height of said crutch system for a user; a handle for hand grip; a top section for armpit rest; a bottom section for traction on ground; one or more connectors to connect said multiple vertical bars together; wherein said top section comprises soft elastic material. Other features/features are:

- wherein said handle is based on a human hand's skeleton structure for easy hand grip and elimination of wrist injury.
- wherein said handle is asymmetric with respect to: the middle of said handle or crutch system or horizontal section or vertical section or connecting bar or supporting middle bar or supporting horizontal bar.
- wherein said handle has variable distance to main body of said crutch system.
- wherein said handle has a support for pointing finger and thumb of said user's hand.
- wherein said handle distributes weight of said user more evenly, to reduce stress on said user's hand, palm of the hand, wrist, and fingers.
- wherein said handle has a cross section which is non-rectangular in shape, when viewed from above said crutch system.
- wherein said handle has a curvature to fit said user's hand.
- wherein said handle has a surface to fit said user's hand.
- wherein said handle is angled with respect to said crutch system.
- wherein said handle is twisted with respect to said crutch system.
- wherein said handle comprises a soft material.
- wherein said handle comprises a rigid material.
- wherein said handle comprises an elastic material.
- wherein said handle comprises a cover or skin.
- wherein said handle comprises a cover or shell which is exchangeable.
- wherein said handle comprises a cover or shell which is washable.
- a spring.
- a rough/coarse cover for better grip.
- crutch system is convertible to a walker system.

Figure 26:
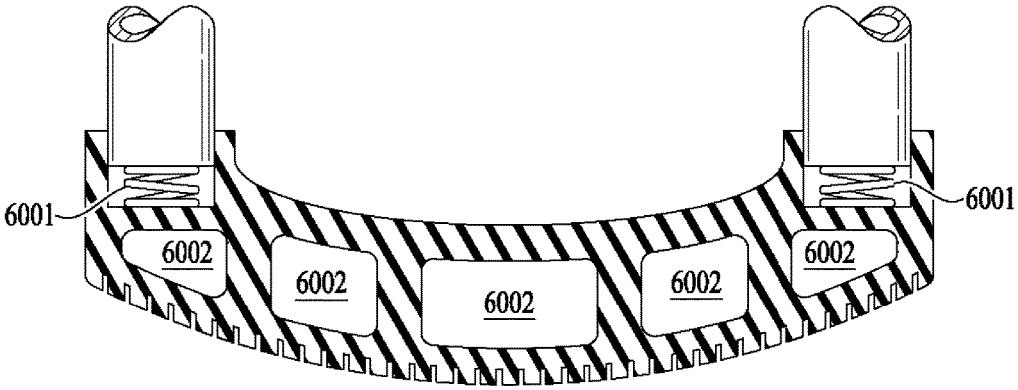
FIG. 26 shows the hollow spaces (6002) that functions as shock absorbent of the base, with spring (6001).
Figure 27:
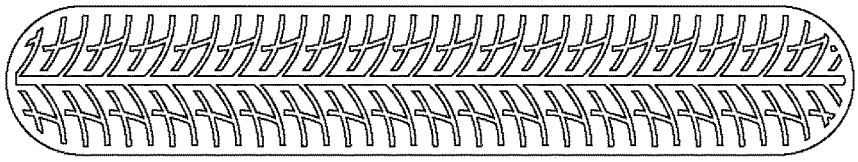
FIG. 27 shows the anti-slip/slide thread design, specifically made for the crutch, which has maximum traction power on the ground, to help stabilize the ambulation, especially in case of inclement weather, e.g., with slippery/icy/frosty/mud/sleet ground conditions.
Figure 28:
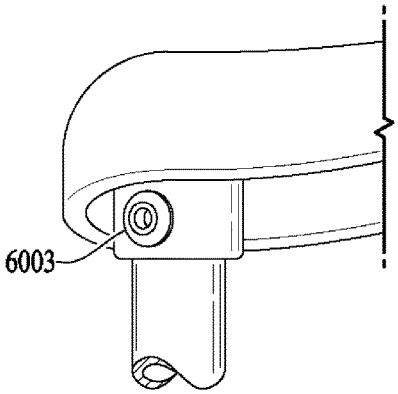
FIG. 28 shows the pressed point 6003 that provides secure attachment of the underarm structure and base (from FIG. 29) to the upright supports/pipes/poles.

FIG. 26 shows the hollow spaces (6002) that functions as shock absorbent of the base, with spring (6001). FIG. 27 shows the anti-slip/slide thread design, specifically made for the crutch, which has maximum traction power on the ground, to help stabilize the ambulation, especially in case of inclement weather, e.g., with slippery/icy/frosty/mud/sleet ground conditions. FIG. 28 shows the pressed point 6003 that provides secure attachment of the underarm structure and base (from FIG. 29) to the upright supports/pipes/poles.

Figure 29:
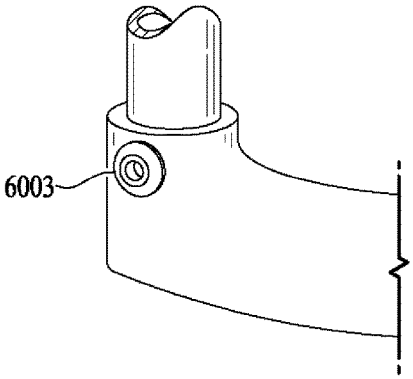
FIG. 29 shows the pressed point that provides secure attachment of the underarm structure (from FIG. 28) and base to the upright supports/pipes/poles.
Figure 31:
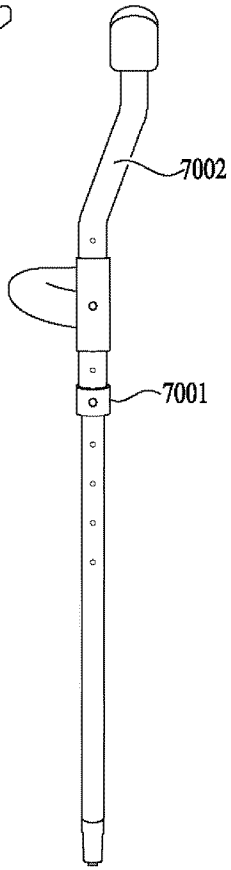
FIG. 31 shows a different design that has a curve in top part/segment of the crutch (as denoted by 7002) to provide more space between two crutches around the waist area for people with large/wide hip.
Figure 30:
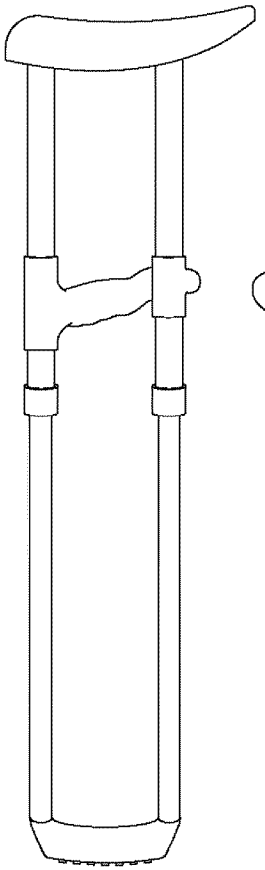
FIG. 30 shows a two-part detachable crutch with special ergonomic handle and cushion that sits/positioned toward the rear.

FIG. 29 shows the pressed point that provides secure attachment of the underarm structure (from FIG. 28) and base to the upright supports/pipes/poles. (FIG. 28 is for the underarm, and FIG. 29 is for the base.) FIG. 30 shows a two-part detachable crutch with special ergonomic handle and cushion that sits/positioned toward the rear. FIG. 31 shows a different design that has a curve in top part/segment of the crutch (as denoted by 7002) to provide more space between two crutches around the waist area for people with large/wide hip.

Figure 33:
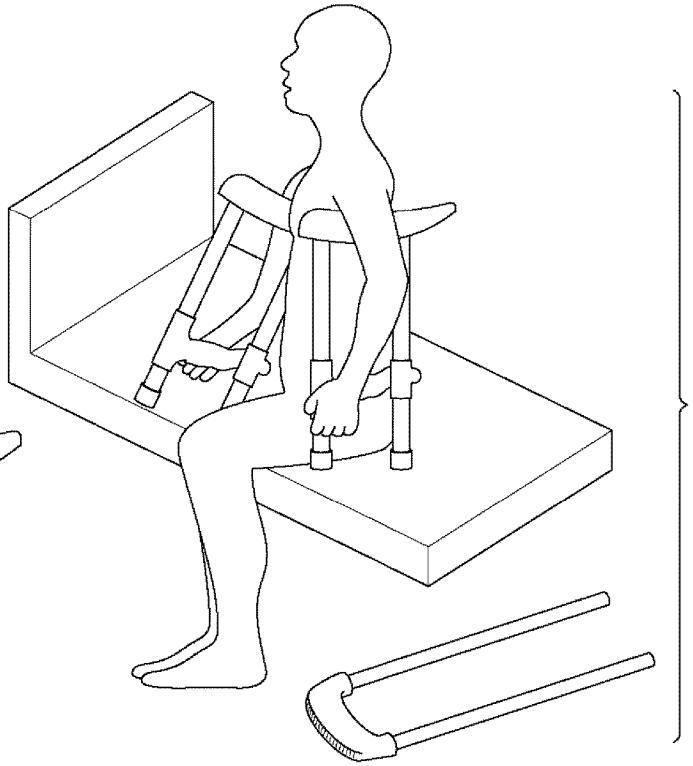
FIG. 33 shows a totally detachable crutch (with two pieces of top and bottom): top part only in use in sitting position, to stretch the upper body or decompression of back/spine.
Figure 32:
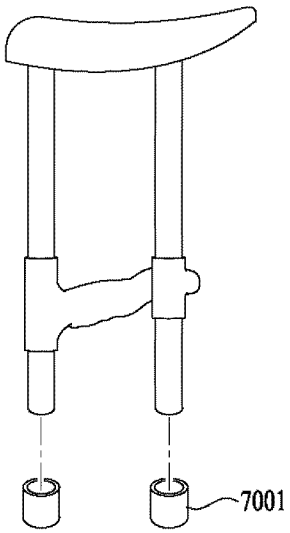
FIG. 32 shows two small caps 7001 which can be used after detaching the top part to prevent the bottom end pipes from piercing/denting the sitting surfaces.

FIG. 32 shows two small caps 7001 which can be used after detaching the top part to prevent the bottom end pipes from piercing/denting the sitting surfaces. FIG. 33 shows a totally detachable crutch (with two pieces of top and bottom): top part only in use in sitting position, to stretch the upper body or decompression of back/spine.

Another embodiment: A pair of crutches that is designed for usage in sitting position, in addition to standing and walking positions. This apparatus can adjust to about the one third of the regular height in order to allow the user to use them in sitting position, therefore, it takes most of the upper body weight off the back and lower spine, in which it helps the user with back Injury in sitting position. Each one of the crutches has three segments that telescopically slide into each other, in order to adjust to the height between a supporting sitting surface, such as chair, to the underarm or armpit of the user, while the user is in the sitting position.

This function helps patients with back and spine injury that are having a hard time to sit and encountering lots of pain, as all the upper body weight is bearing on lower injured back, while sitting. This function also creates a traction system in sitting position, as the adjusted crutch pushes up the user's body/torso against the gravity force, therefore, helps to reduce the spine pressure over possible bulge discs and pinching nerves, which cause pain and numbness in body, and also improves postural alignment, while seated. The pair of crutches also have an ergonomic grip that eases the handling process and reduces the pressure on the wrist (and allows/encourages the user to distribute some of the weight on the handles, instead of leaving all the weight on the vulnerable under arm area).

Some of the features are as follows:

A pair of multi-functional crutches comprising of under-arm cushions and three body segments which telescopically slide into each other to transform the regular crutch to a sitting crutch for patients who may have difficulty and pain, while sitting, due to the body weight pressure on the injured back and spine. It also has the new ergonomic handle design which helps user to bear most of the user's weight on the palm of her hands, and not on her wrists (e.g., see FIGS. 1, 3, and 7, plus Appendix 1, for more details).

The material and size of the system or apparatus described here can be widely diverse and different, e.g., made of wood, plastic, elastic, rubber, artificial materials, partially wool for cover (or fabric), glass, fiber glass, crystal, metal, alloy, carbon, carbon fiber, polymers, ceramic, transparent materials, translucent materials, glued materials, layered or stacked materials, or the like, and e.g., for sizes from about 0.25 ft as lower end of the range, to 6 ft, as upper range or values, in overall length and height, or from a few mm to a few inches for other dimensions for components and connections/connectors, in the images shown, just as examples. However, these numbers and materials are just examples, and not limiting the invention by any means, in spec or figures or for any purpose.

Any variations and any combinations of the above teachings are also intended to be covered by this patent application.

The invention claimed is:

1. A crutch system, said crutch system comprising:
multiple vertical bars;
wherein said multiple vertical bars are connected together;
wherein said multiple vertical bars are adjustable in length, to adjust height of said crutch system for a user;
wherein a bottom part of said multiple vertical bars is removable such that an upper part of said multiple vertical bars is used as a shorter crutch to assist the user in a sitting position;
a handle for hand grip;
wherein said handle's front side thickness is smaller than said handle's back side thickness;
a top section for armpit rest;
a bottom section for traction on ground;
wherein said bottom section is attached to bottom of said bottom part of said multiple vertical bars;
one or more connectors to connect said multiple vertical bars together;
wherein said top section comprises soft or elastic material.

2. The crutch system as recited in claim 1, wherein said handle is asymmetric with respect to said multiple vertical bars.

3. The crutch system as recited in claim 1, wherein said handle comprises a soft material.

4. The crutch system as recited in claim 1, wherein said handle comprises a rigid material.

5. The crutch system as recited in claim 1, wherein said handle comprises an elastic material.

6. The crutch system as recited in claim 1, wherein said handle comprises a cover or skin.

7. The crutch systems recited in claim 1, wherein said handle comprises a cover or shell which is exchangeable.

8. The crutch system as recited in claim 1, wherein said handle comprises a cover or shell which is washable.

9. The crutch system as recited in claim 1, said crutch system comprises a spring.

10. The crutch system as recited in claim 1, said crutch system comprises a rough or coarse cover, shell, or surface for better grip.

* * * * *